United States Patent [19]

Sharma

[11] Patent Number: 4,917,724

[45] Date of Patent: Apr. 17, 1990

[54] METHOD OF DECALCIFYING RARE EARTH METALS FORMED BY THE REDUCTION-DIFFUSION PROCESS

[75] Inventor: Ram A. Sharma, Troy, Mich.

[73] Assignee: General Motors Corporation, Detroit, Mich.

[21] Appl. No.: 255,700

[22] Filed: Oct. 11, 1988

[51] Int. Cl.[4] ..... B22F 1/00

[52] U.S. Cl. ..... 75/350; 75/364; 252/62.55; 148/301; 148/302; 420/83; 420/121

[58] Field of Search ..... 252/62.55, 62.56, 62.57, 252/62.58, 62.63; 148/105, 108, 302, 301; 423/159, 162; 75/101 R, 121; 420/83, 121

[56] References Cited

U.S. PATENT DOCUMENTS

| | | | |
|---|---|---|---|
| 3,625,779 | 12/1971 | Cech | 148/101 |
| 3,748,193 | 7/1973 | Cech | 148/101 |
| 3,912,554 | 10/1975 | Arendt et al. | 148/105 |
| 3,918,933 | 11/1975 | Martin | 75/0.5 BA |
| 3,928,089 | 12/1975 | Cech | 148/105 |
| 4,681,623 | 7/1987 | Akajima et al. | 75/0.5 BB |

*Primary Examiner*—Robert L. Stoll

*Attorney, Agent, or Firm*—Lawrence B. Plant

[57] ABSTRACT

Mixtures of a rare earth and an intermetallic compound comprising the rare earth and a ferromagnetic metal selected from the group consisting of iron and cobalt which are formed by the reduction-diffusion process are decalcified by washing with an aqueous ammoniacal solution comprising a reagent capable of forming a calcium salt soluble in alkaline solution and maintaining the pH of the washing solution above 9.0.

11 Claims, No Drawings

METHOD OF DECALCIFYING RARE EARTH METALS FORMED BY THE REDUCTION-DIFFUSION PROCESS

TECHNICAL FIELD

The present invention relates generally to a method for producing mixtures of rare earth metals and alloys thereof with iron and cobalt by a calcium reduction-diffusion process and more specifically to separating calcium and calcium oxide from the reaction products thereof with little or no loss of elemental rare earth from the mixture.

BACKGROUND OF THE INVENTION

Rare earth permanent magnets have found particular utility in many commercial applications, including electric motors, NMR scanners, and the like. The advantage of permanent magnets in these applications is their ability to exhibit high level, constant magnetic fluxes without applying an external magnetic field or electrical current. Early such magnets include samarium-cobalt rare earth intermetallic compounds, such as $SmCO_5$ and $Sm_2CO_{17}$. More recently, iron-neodymium-boron and other rare earth-iron/cobalt-based intermetallics have been investigated due to their superior magnetic properties. Magnets made from some of these rare earth-iron/-cobalt-based intermetallics (e.g., $Nd_2Fe_{14}B_1$) are known to require the presence of some (i.e., about 2%-5%) elemental rare earth for optimal properties. Consequently, it is imperative to maintain a higher than stoichiometric level (i.e., for the intermetallic) of the rare earth in the final product.

A known method of making samarium-cobalt and other rare earth-iron/cobalt-based magnetic powders is by the so-called "reduction-diffusion" process wherein rare earth compounds such as rare earth oxides, chlorides or fluorides are reduced with a stoichiometric excess (i.e., about 30% excess) of elemental calcium or calcium hydride in the presence of the iron and/or cobalt (or Ca-reducible compounds thereof) and the resulting rare earth diffused into the iron/cobalt at elevated temperatures. Subsequent processing produces a Ca-free metallic powder which is ground into particles small enough (i.e., about 1-5 microns) to contain a preferred magnetic domain. The particles are then aligned in a magnetic field and pressed to form a compact and prevent relative motion of the particles. The compact is then sintered, heat treated and magnetized in the prealigned direction.

In conventional samarium-cobalt reduction-diffusion processes, samarium oxide, calcium and/or calcium hydride and cobalt are heated together to reduce the samarium oxide and diffuse the samarium into the cobalt. The resulting mass of rare earth-intermetallic, calcium oxide and unreacted calcium is hydrated with water to alkalize the Ca/CaO and form calcium hydroxide therefrom. The heavier intermetallic settles out while dissolved and undissolved $Ca(OH)_2$ floating in the supernatant liquid are removed by decantation. Thereafter, the intermetallic is washed with a weak acid (e.g., acetic acid) or an acidic solution of $NH_4Cl$ to remove any residual $Ca(OH)_2$ therefrom.

The aforesaid process for making samarium-cobalt magnetics powders has been proposed for making other rare earth-ferromagnetic metal alloy powders. The $Ca(OH)_2$-removal process used in the samarium-cobalt process, however, has not proved effective to produce rare earth intermetallics which require a second, elemental rare earth phase for optimal magnetics (e.g., $Nd_2Fe_{14}B_1$ and Nd). In this regard, removal of the calcium hydroxide from Nd and $Nd_2Fe_{14}B_1$ mixtures by washing with acid serves only to dissolve the highly reactive elemental rare earth phase and thereby leave the resulting mixture too lean with respect to elemental rare earth content for optimal magnetic properties.

Accordingly, it is the primary object of the present invention to provide an improved process for stripping $Ca(OH)_2$ from hydrated, rare earth reduction-diffusion products having an elemental rare earth component (preferably Nd plus $Nd_2Fe_{14}B_1$) without losing the rare earth component. It is another object of the present invention to provide a substantially continuous closed-loop process for removing $Ca(OH)_2$ from a mixture of hydrated reduction-diffusion-prepared Nd plus $Nd_2Fe_{14}B_1$ without losing the elemental Nd therefrom. These and other objects and advantages of the present invention will become more readily apparent from the detailed description thereof which follows.

SUMMARY OF THE INVENTION

In accordance with the present invention, a reduction-diffusion method is provided for preparing a mixture of a rare earth and an intermetallic compound thereof with iron and/or cobalt (e.g., Nd plus $Nd_2Fe_{14}B_1$) which method initially includes reducing a compound of the rare earth (e.g., $Nd_2O_3$) with excess calcium at an elevated temperature (i.e., above about 900° C. for about 3 hours) in the presence of the iron and/or cobalt and then allowing the rare earth metal to diffuse into the iron/cobalt by raising the temperature over 1100° C. and soaking for at least 3 hours. Preferably a small amount of boron or ferro-boron is also present to obtain stronger magnets. The other metals (e.g., iron, cobalt, ferro-boron, etc.) may be present in the reactor either as elements or as compounds reducible by the calcium and alloyable with the rare earth. A preferred reaction involves the reduction of $Nd_2O_3$ by Ca in the presence of Fe and $Fe_4B_6$ (i.e., at about 900° C.-1200° C.) to yield a mass comprising Ca, CaO and a neodymium-iron-boron mixture comprising 15 atomic percent Nd, eight atomic percent boron and 77 atomic percent iron. This mixture consists primarily of the $Nd_2Fe_{14}B$ intermetallic, and small amounts of Nd and the $Nd_2Fe_7B_6$ intermetallic. Following reduction, the mass is heated to about 1150° C. for a sufficient period (i.e., about 3 hours) to diffuse the Nd into the Fe and B. Thereafter, the mixture is hydrated in water in a substantially $CO_2$-free environment to alkalize excess Ca and the CaO formed and to produce a mass of substantially $CaCO_3$-free particles having a heavier fraction comprising principally the metallic components of the mass and a lighter fraction comprising principally $Ca(OH)_2$ and a small amount of the metals entrained therein. The lighter fraction contains fine $Ca(OH)_2$ particles believed to be derived primarily from the hydration of the excess Ca and coarser particles believed to be primarily derived from the hydration of the CaO. The entrained metal is believed to be concentrated more in the coarser particles than in fine particles. Following hydration and in accordance with the present invention, the calcium hydroxide is reacted with a reagent which forms a calcium salt soluble in an alkaline solution which has a pH greater than 9.0 and sufficient to prevent dissolution of the elemental rare earth entrained in the $Ca(OH)_2$, or in the heavier fraction. The solution containing the dissolved calcium salt is removed (e.g., by siphoning or decantation). In a preferred embodiment, the alkaline solution will be ammoniacal and include ammonium acetate or ammonium formate as the reagent of choice. Alternatively, ammonium hydroxide may be first added to the solution and dissolution of the $Ca(OH)_2$ thereafter affected by addition of formic acid, acetic acid, ammonium chloride or dilute hydrochloric acid.

While not wishing to be bound by theory, it is believed that the elemental rare earth component of the reduction-diffusion product is passivated by the formation of an hydroxide film/shell thereover which prevents reaction thereof with the reagent used to react with the $Ca(OH)_2$. In the case of neodymium, passivation [i.e., $Nd(OH)_3$-formation] has been shown to occur at pH's above about 9.0. The soluble calcium salts are more easily formed and more readily soluble at pHs closer to 9 than at higher pHs (i.e., above about 12). Hence, while the invention may be practiced at pHs ranging from 9.0 to about 12.5, it is preferred to control the alkalinity of the salt-forming solution at a pH of about 9.5 to about 10.

While the rare earth composition of greatest interest is neodymium-iron-boron, the method of the present invention may be practiced with other reduction-diffusion processes involving rare earth intermetallics which require the presence of a second phase of elemental rare earth for optimal magnetics. Hence, the process of this invention may be used with (1) rare earth metals selected from the lanthanide series (atomic numbers 57 to 71), the actinide series (atomic numbers 89 to 103), and yttrium (atomic number 39) and (2) intermetallic alloys thereof with iron and/or cobalt.

The present process does not interfere with the presence of relatively small amounts of other elements and compounds such as aluminum, silicon, dysprosium, copper, etc., which may be present for a variety of metallurgical reasons, e.g., grain refinement.

DETAILED DESCRIPTION OF CERTAIN PREFERRED EMBODIMENTS OF THE INVENTION

In one preferred embodiment according to the present invention neodymium oxide ($Nd_2O_3$) is reduced by calcium in a controlled atmosphere furnace and in the presence of iron and boron at about 900° C. and further heated at about 1150° C. to diffuse the rare earth into the iron/boron. The reduction-diffusion reaction is essentially as follows:

$$\frac{15}{2} Nd_2O_3 + 72Fe + \frac{4}{30} Fe_{40}B_{60} + \frac{45}{2} Ca \xrightarrow[\text{vac}]{900\text{–}1200^\circ\text{ C.}} Nd_{15}Fe_{77}B_8 + \frac{45}{2} CaO$$

The reduction-diffusion steps yield a hard, black, porous cake which is then hydrated with water to alkalize the calcium oxide formed and excess Ca to convert it to calcium hydroxide. The hydration step causes the cake to crumble without the need for a separate crushing operation. However, crushing of the cake before hydration is desirable to facilitate the alkalization/crumbling process. The calcium hydroxide, which is nearly insoluble, must be removed from the system without also removing neodymium therefrom. Removal is preferably carried out by adding aqueous ammonium acetate to the water containing the $Ca(OH)_2$. The ammonium acetate reacts with the calcium hydroxide in alkaline solution to form $NH_4OH$ and calcium acetate which has a solubility of about 27% at 273° K. in weakly alkaline (i.e., pH 9–12) solution. The $NH_4OH$ formed maintains the pH of the solution in a region where the Nd is protected by formation of a $Nd(OH)_3$ coating/shell thereover and accordingly does not undergo any noticeable reaction with the acetate. By keeping the pH at a level above about 9.0 the elemental neodymium that was entrained in the $Ca(OH)_2$ is protected from dissolution while the $Ca(OH)_2$ is dissolved away from it thereby allowing it to settle to the bottom of the dissolution vessel. Alternatively, ammonium formate or mixtures of ammonium hydroxide and either acetic acid, formic acid, ammonium chloride or dilute HCl may be used in lieu of ammonium acetate.

SPECIFIC EXAMPLE

Neodymium oxide ($Nd_2O_3$) powder containing about 95% $Nd_2O_3$ and about 5% praseodymium oxide was dried at 500° C. The $Nd_2O_3$ was reacted with about 99.5% pure Ca in the presence of iron and ferro-boron powder plus a small amount of pure aluminum powder (i.e., 20–40 micron) to decrease grain growth during the magnet sintering process.

The reduction-diffusion steps were carried out in a sealed stainless steel crucible/reactor ($2\frac{1}{2}$ in. high by 3 in. O.D.). The crucible interior was ($2\frac{1}{2}$ in. high by $3\frac{1}{4}$ O.D.). The crucible interior was coated with a CaO-methanol paste and dried to remove the methanol prior to loading the reaction charge. The bottom of the outer crucible was also coated with the CaO paste and dried to insure that the two crucibles did not sinter to one another during the high temperature heat soak. A lid coated on the underside with CaO paste was placed over the crucibles and the assembly lowered into an evacuable, stainless steel cylindrical furnace well.

The reactants for each reduction-diffusion batch were weighed and roller blended for at least 24 hours. With the exception of the calcium, the following weights of materials were used in each of several batches: $Nd_2O_3$=97 g, Fe=103 g, FeB =12 g, and Al=1 g. The calcium varied from a low of 26 g to a high of 86.8 g (i.e., between −25% to +150% of the stoichiometric amount of Ca required). About 30 percent excess Ca of over the stoichiometric amount is generally desirable.

High purity argon gas was slowly flowed through the stainless steel reactor during the reduction-diffusion step. The charge was heated up at a rate of 5° C. per minute to 900° C. and held at this temperature for three hours to carry out the reduction step and then heated up further at a rate of 5° C. per minute to over 1100° C. (i.e., up to as high as 1177° C.) and held for 3 hours at this temperature for the reactants to diffuse. The furnace was then allowed to cool naturally to about 600° C.–500° C. followed by air quenching the crucible to room temperature. The reaction mass removed from the reactor comprised a fused cake having a porous, clinkerlike structure.

The cake comprising the reaction mass was transferred to a 20 liter jar for removal of the excess calcium and the calcium oxide formed in the reaction. About 18 liters of deionized (DI) water were added and the jar covered with plastic wrap (i.e., to avoid the formation of $CaCO_3$ by reaction with atmospheric carbon dioxide). High purity argon was bubbled through the solution and the mass allowed to stand/hydrate for about 72 hours to alkalize the Ca/CaO. The hydration reaction caused the cake to crumble/disintegrate into a mass of particles having a lighter fraction comprising $Ca(OH)_2$ having a small amount of metal (i.e., Nd plus $Nd_2Fe_{14}B_1$) entrained therein and a heavier fraction comprising principally metal with some $Ca(OH)_2$ attached thereto. The calcium hydroxide maintained the pH at about 12 during hydration and the supernatant liquid had a milky appearance.

After hydration was complete, the slurry produced was stirred vigorously for ½ hour in a substantially $CO_2$-free environment to free as much of the $Ca(OH)_2$ as possible from the metal and dissolve as much as possible into the water. The stirrer was then turned off and the alloy powder allowed to settle for five to ten minutes. The finer $Ca(OH)_2$ particles remained suspended in the liquid giving a milky appearance to the supernatant liquid which was siphoned off. The larger metal entraining $Ca(OH)_2$ particles and the heavier metal particles that had settled to the bottom were then repeatedly washed as follows. About 18 liters of DI water containing 20 cc of a 10% $NH_4OH$ solution were added to the settled particles and the solution stirred vigorously as before. The milky appearance reappeared. Ten percent acetic acid and ten percent $NH_4OH$ solutions were then slowly added to the stirring solution so as to keep the pH from dropping below 9.0 (preferably 9.5–10). The milky color gradually disappeared as the suspended calcium hydroxide reacted with the acetic acid to form calcium acetate which dissolved in the solution. When the milky appearance disappeared (i.e., after about 10 minutes), stirring was stopped, the alloy powder allowed to settle and the relatively clear supernatant liquid siphoned off. The aforesaid wash and reaction cycle was repeated at least five times until no residual calcium hydroxide was in the metal powder (i.e., as determined from microscopic examination).

The $Ca(OH)_2$-free powder was then rinsed three times with DI water, rinsed twice with acetone and transferred to a Buchner funnel by a third acetone rinse where it was air dried. The air dried powder was sieved through a 60 mesh sieve, transferred to a desiccator and vacuum dried overnight. After removal from the vacuum desiccator it was stored in an air-tight container to prevent air oxidation of the fine powder.

A number of parameters were changed from one batch to the next. For example, the soak temperature was varied from 1100° C. (run 5) to as high as 1177° C. (run 13) with the majority of the runs being between 1125°–1150° C. No pattern of product quality or yield was apparent with this variation of temperature, and all temperatures appeared to be adequate to produce the magnetic alloy powders. In this regard, to observe the extent of neodymium diffusion into the iron particles, pure iron wires were included in several test runs. After the hydration process was completed, the wires were recovered, placed in metallographic mounts and polished. Back-scattered electron photomicrographs of the samples were made and the diffusion of the neodymium into the iron was readily apparent. The average diffusion depth, as obtained by scanning electron microscopy, was 40 microns. The particle size of the iron powder, as measured by optical microscopy, was approximately 30 microns. Hence the soak time-temperature utilized was sufficient to completely diffuse the neodymium into the iron particles and produce a homogeneous magnet alloy powder. Photomicrographs produced using a back-scattered electron detector in the scanning electron microscope showed the presence of the alloy phases and elemental neodymium in the reaction masses produced.

Moreover, variations in the washing procedure, such as changing the order of addition of ammonium hydroxide and acetic acid or using a premixed 10% ammonium acetate solution had no affect on the results obtained. The table shows the parameters/results of a number of the aforesaid tests including: soak temperatures for diffusing the rare earth into the iron and homogenization of the magnet alloy powder; the amount of calcium and excess thereof over the stoichiometric amount required to reduce $Nd_2O_3$; the yield of the washed magnet alloy powder; and its chemical analysis. The tests showed that it was necessary to maintain an alkaline solution of greater than pH 9 to form the calcium acetate without reacting the Nd. Tests 14, 15 and 22, for example, (i.e., where the pH was below 7 for a few minutes), resulted in alloys having a low neodymium content. The use of an ammoniacal solution was found to be particularly beneficial in buffering the solution in preventing the pH from even momentarily or locally dropping too low and thereby permitting the calcium acetate to form without consuming any appreciable Nd.

The stoichiometric amount of Nd, and the Nd to Fe ratio in $Nd_2Fe_{14}B$ are 26.68 wt. % and 0.369, respectively. The results in the Table indicate that in most of the experiments the neodymium content and the Nd to Fe ratio are greater than those in the $Nd_2Fe_{14}B$ compound even when the calcium content in the magnetic alloy is ~0.1 wt. %. This shows that the $Ca(OH)_2$ can be removed by reacting it with a reagent which forms a calcium salt soluble in alkaline solution without substantially lowering the neodymium content of these alloys.

The calcium granules used in the initial runs produced coarser reaction masses than those that were later made using spherical calcium metal powder. All runs made with the spherical powder had a product of more uniform porosity which hydrated well and permitted easier separation of the alloy powder and the salt.

TABLE

Description of Reduction/Diffusion Experiments

| Expt. Number | Soak Temp. C | Ca Added (gm) | % Over Stoichiometry | Yield % | Analysis (w/o) Nd | Fe | B | Al | Ca |
|---|---|---|---|---|---|---|---|---|---|
| 1 | 1120 | 52 | 50 | — | 33.1 | 58.4 | 1.15 | 0.5 | 0.3 |
| 2 | 1125 | 52 | 50 | 89 | 37.2 | 55.9 | 1.2 | 0.6 | 0.3 |
| 3 | 1125 | 52 | 50 | 105 | 34.4 | 59.3 | 1.1 | 0.47 | 0.25 |
| 4 | 1085 | 52 | 50 | 94.8 | 34.6 | 57.5 | 1.14 | 0.59 | 0.63 |
| 5 | 1100 | 52 | 50 | 95.2 | 33.6 | 56.5 | 1.09 | 0.59 | 0.65 |
| 6 | 1125 | 52 | 50 | 90.8 | 36.1 | 55.8 | 1.19 | 0.6 | 0.2 |
| 7 | 1150 | 52 | 50 | 96.7 | 35 | 55.1 | 1.1 | 0.6 | 0.5 |
| 8 | 1150 | 52 | 50 | 82 | 34.8 | 54.9 | 1 | 0.6 | 0.6 |
| 9 | 1150 | 26 | −25 | 60.5 | 19.3 | 68.9 | 1.34 | 0.6 | 0.5 |

TABLE-continued

| Expt. Number | Soak Temp. C | Ca Added (gm) | % Over Stoichiometry | Yield % | Nd | Fe | B | Al | Ca |
|---|---|---|---|---|---|---|---|---|---|
| | Description of Reduction/Diffusion Experiments | | | | Analysis (w/o) | | | | |
| 10 | 1150 | 52 | 50 | 87 | 34.7 | 53.6 | 1.1 | 0.3 | 2.9 |
| 11 | 1150 | 52 | 50 | 82.6 | 35.9 | 56.3 | 1.1 | 0.5 | 0.3 |
| 12 | 1150 | 86.8 | 150 | 84.7 | 34.4 | 57.7 | 1.1 | 0.6 | 0.5 |
| 13 | 1177 | 86.8 | 150 | 78.7 | 31.6 | 61.3 | 1.1 | 0.4 | <0.1 |
| 14 | 1105 | 86.8 | 150 | 75.2 | 25.6 | 67.6 | 1.01 | 0.6 | <0.1 |
| 15 | 1122 | 86.8 | 150 | 76.7 | 29 | 63 | 0.097 | <0.1 | 0.98 |
| 16 | 1122 | 86.8 | 150 | 72 | 32.5 | 60.7 | 1.17 | 0.5 | 0.1 |
| 17 | 1100 | 52 | 50 | 88 | 33.2 | 61 | 1.16 | 0.5 | 0.2 |
| 18 | 1125 | 69.3 | 100 | 65 | 31.9 | 63.1 | 1.18 | <0.1 | 0.1 |
| 19 | 1136 | 43.3 | 25 | 56 | 33.9 | 61.6 | 1.1 | 0.5 | 0.9 |
| 20 | 1140 | 43.3 | 25 | 43 | 32.4 | 62.8 | 1.1 | 0.66 | 0.04 |
| 21 | 1134 | 43.3 | 25 | 66 | 29.9 | 64.4 | 1.07 | 0.7 | 0.85 |
| 22 | 1128 | 43.3 | 25 | 53.7 | 28.6 | 65.1 | 1.02 | 0.4 | 0.16 |
| 23 | 1130 | 43.3 | 25 | 70 | 32 | 62 | 1.1 | 0.5 | 0.1 |
| 24 | 1105 | 43.3 | 25 | 72.9 | 32 | 62.4 | 1.2 | 0.6 | 0.1 |
| 25 | 1125 | 52 | 50 | 64 | 16.2 | 76.1 | 0.4 | <0.1 | 0.4 |
| 26 | 1126 | 52 | 50 | 78 | 26.3 | 66.9 | 1.1 | 0.5 | <0.1 |
| 27 | 1130 | 52 | 50 | 44.9 | 6.6 | 87.5 | 0.8 | <0.1 | 0.1 |
| 28 | 1133 | 52 | 50 | 75.7 | 32.5 | 61.5 | 1.1 | 0.5 | 0.2 |

Based on the tests performed, the following batch procedure is suggested for removing Ca/CaO from neodymium-iron-boron reduction-diffusion products or a laboratory scale:

1. Place the reduction-diffusion cake in a 20 liter plastic beaker and add 15liters of deionized (D.I.) water and 50 cc of conc. $NH_4OH$ solution per 1000 g of cake.
2. Cover the beaker to avoid formation of $CaCO_3$ by reaction of the $Ca(OH)_2$ with $CO_2$ in atmosphere.
3. Allow the beaker to stand for 48 hours.
4. If any $CaCO_3$ forms on the solution surface during stand, dissolve it by slowly squirting a 10% acetic acid solution over the surface.
5. Position a stirrer in the solution so that its blade is near the bottom of the beaker and stir vigorously (about 1500 rpm) for about ½ hour. Lift the stirrer blade to a midway position in the solution. Stir the solution at a slower rate (about 300 rpm) that keeps the $Ca(OH)_2$ in suspension but allows the alloy powder to settle to the bottom.
6. Siphon off the $Ca(OH)_2$ slurry without removing the alloy powder.
7. Add about 10 liters of D.I. water and about 10 cc of a 10% $NH_4OH$ solution to the beaker. Repeat steps 5 and 6 reducing fast stirring time to 10 minutes. Repeat this step several times until the $Ca(OH)_2$ is mostly in solution and the solution appears milky due to the presence of undissolved $Ca(OH)_2$.
8. Place the stirrer blade near the bottom of the beaker and stir the solution vigorously. Slowly add a 10% $NH_4OH$ solution to the mixture until it gives an $NH_3$ smell.
9. Gradually add a 10% acetic acid solution (i.e., maintaining the $NH_3$ smell at all times to insure a sufficiently high pH) until the milky color disappears.
10. Siphon/decant the clear solution off.
11. Wash the alloy powder three times with D.I. water set forth in step 7.

Commercially, decalcification would preferably be practiced on a substantially continuous closed-loop basis such as described hereafter. The particles from the hydrated/disintegrated cake are placed in a vertical dissolution column having an inlet at its bottom end, an outlet at its upper end, means for distributing liquid flow substantially uniformly upwardly through the column and a very fine porous filter media at the outlet for preventing fine particles from escaping the column as washing fluid passes upwardly therethrough. The washing fluid comprises an ammonium acetate solution having a pH greater between 9 and about 12 which is flowed upwardly through the column at a rate which permits the lighter $Ca(OH)_2$-rich particles to be carried higher up in the column than the heavier metal-rich particles which remain in the lower region of the column. The calcium acetate-containing effluent from the column passes to a separate regeneration reactor where ammonium carbonate is added thereto to precipitate calcium carbonate and regenerate ammonium acetate. The regenerator reactor's effluent is filtered to remove the calcium carbonate precipitate and the filtrate recirculated to the inlet of the dissolution column. The pH of the column's effluent is monitored to insure that it never falls below 9.0 (preferably not below about 9.5). Any needed ammonium acetate make-up or pH adjustment is accomplished before the regenerated ammonium acetate is returned to the dissolution column. The process continues until substantially all of the calcium hydroxide is removed from the metal particles. Before removing the particles from the column they are first flushed with dilute (i.e., 10%) $NH_4OH$ solution and finally with deionized water to dissolve the final remnants of $Ca(OH)_2$ therein.

While the invention has been described in conjunction with specific embodiments thereof, it is evident that many alternatives, modifications and variations will be apparent to those skilled in the art in light of the foregoing description and example. Accordingly, it is intended to embrace all such alternatives, modifications, and variations as fall within the spirit and scope of the appended claims.

The embodiments of the invention in which an exclusive property or privilege is claimed are defined as follows:

1. A method for preparing a mixture of a rare earth and an intermetallic compound comprising said rare earth and a ferromagnetic metal selected from the group consisting of iron and cobalt comprising the steps of:

(a) reducing a compound of said rare earth with calcium in the presence of said metal at an elevated temperature;

(b) heating the product of the reducing step for a time and at an elevated temperature sufficient to diffuse most of said rare earth into said metal and produce a cake of said mixture containing CaO and unreacted Ca;

(c) hydrating said cake with water in a substantially $CO_2$-free environment to alkalize said CaO and Ca into $Ca(OH)_2$ and crumble said cake into a mass of particles having a first fraction comprising principally $Ca(OH)_2$ having a portion of said mixture entrained therein and a second fraction comprising principally said mixture;

(d) treating said first fraction with an aqueous alkaline solution containing a reagent capable of forming a calcium salt soluble in said solution;

(e) maintaining said solution at a pH sufficiently greater than 9.0 during said treating step to substantially prevent dissolution of said rare earth while forming said; and (f) removing said solution from said mixture; whereby said $Ca(OH)_2$ is separated from said mass with substantially no loss of said rare earth therfrom.

2. A method according to claim 1 wherein said alkaline solution is ammoniacal.

3. A method according to claim 2 wherein said rare earth is selected from the group consisting of neodymium and praseodymium.

4. A method according to claim 3 wherein said reagent is selected from the group consisting of ammonium acetate and ammonium formate.

5. A method according to claim 3 wherein said reagent is formed in situ in said solution by the addition thereto of $NH_4OH$ and a compound selected from the group consisting of acetic acid, formic acid, dilute hydrochloric acid and ammonium chloride.

6. The method according to claim 3 including the steps of agitating said mass in water to substantially detach said first fraction particles from said second fraction particles, substantially separating the first fraction particles from the second fraction particles, reacting substantially only the separated first fraction particles with said reagent and repeating the foregoing agitating separating and reacting steps as necessary until substantially all of the $Ca(OH)_2$ has been removed from the said second fraction particles.

7. The method according to claim 6 wherein a substantial portion of said solution is removed from the mixture between each repetition of the agitating, separating and reacting steps.

8. The method according to claim 3 wherein said solution is substantially continuously flowed through said mass until substantially all of said $Ca(OH)_2$ is removed.

9. The method according to claim 8 wherein the effluent solution exiting said bed is treated to precipitate and remove calcium therefrom, rejuvenate said reagent therein and recirculated through said bed.

10. The method according to claim 9 wherein said reagent is selected from the group consisting of ammonium acetate and ammonium formate.

11. The method according to claim 10 wherein said effluent solution is treated with ammonium carbonate.

* * * * *